US007249965B2

(12) United States Patent
Hasegawa et al.

(10) Patent No.: US 7,249,965 B2
(45) Date of Patent: Jul. 31, 2007

(54) STARTER

(75) Inventors: Youichi Hasegawa, Kasugai (JP); Yoshinori Yamaguchi, Kariya (JP); Hisato Inoue, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/584,659

(22) Filed: Oct. 23, 2006

(65) Prior Publication Data

US 2007/0093113 A1 Apr. 26, 2007

(30) Foreign Application Priority Data

Oct. 25, 2005 (JP) ..... 2005-309839

(51) Int. Cl.
*H01R 27/00* (2006.01)

(52) U.S. Cl. ..... 439/516; 439/949

(58) Field of Classification Search ..... 439/516, 439/926, 949; 310/68 C, 71; 318/434; 290/38 R
See application file for complete search history.

(56) References Cited

U.S. PATENT DOCUMENTS 6,231,348 B1 * 5/2001 Mayer et al. ..... 439/33
6,851,972 B2 * 2/2005 Koide et al. ..... 439/516
7,067,934 B2 6/2006 Kitagawa et al.
2005/0206256 A1 * 9/2005 Reed et al. ..... 310/71
2006/0135002 A1 * 6/2006 Imanishi et al. ..... 439/793
2007/0026729 A1 * 2/2007 Ochiai et al. ..... 439/516

FOREIGN PATENT DOCUMENTS

JP A 11-289724 10/1999
JP A 2005-110484 4/2005
JP A 2005-271869 10/2005

OTHER PUBLICATIONS

U.S. Appl. No. 11/522,909, filed Oct. 23, 2006.

* cited by examiner

*Primary Examiner*—James R. Harvey
(74) *Attorney, Agent, or Firm*—Oliff & Berridge, PLC

(57) ABSTRACT

The DC motor of the starter includes first and second field coils, an armature coil series-connected to one ends of the first and second field coils through a brush device, a connector bar to which other ends of the first and second field coils are connected, a motor lead joined to a joint point of the connector bar at one end thereof, and an electromagnetic switch operative to connect the other end of the motor lead to a battery. The connector bar is made of steel, the other end of the first field coil is connected to a first connection point in the connector bar, and the other end of the second field coil is connected to a second connection point. The distance between the joint point and the second connection point is longer than a distance between the joint point and the first connection point.

5 Claims, 5 Drawing Sheets

La≤Lb

STARTER

CROSS-REFERENCE TO RELATED APPLICATION

This application is related to Japanese Patent Application No. 2005-309839 filed on Oct. 25, 2005, the contents of which are hereby incorporated by reference.

BACKGROUND OF THE INVENTION

Field of the Invention

The present invention relates to a starter for starting a vehicle engine, and more particularly to a starter having a structure in which a plurality of field coils are connected to a connector bar having a fuse function.

There is known, as disclosed in Japanese Patent Application Laid-open No. 2005-110484, a starter including a permanent magnet field type DC motor provided with an intermediate plate for electrically and mechanically connecting a motor lead connected to a motor terminal of an electromagnetic switch to a lead of a positive brush located on a commutator of an armature of the DC motor. This intermediate plate is made of steel having a higher electrical resistance than copper, so that the intermediate plate melts by Joule heat when a power supply circuit of the DC motor is applied with an excessive thermal load, to thereby interrupt supply of electric power to the power supply circuit.

Also, it is known to provide a wound field type DC motor having a plurality of field coils with a connector bar for electrically connecting a motor lead to the plurality of the field coils. It is possible for the connector bar to have the fusing function as described above, if this connector bar is steel made. However, when the connector bar is made of steel, the below described problem arises in a case where the DC motor has a configuration as shown in FIG. 2 in which a plurality of field coils are connected to different portions (referred to as connection points hereinafter) of the connector bar 38. In FIG. 2, for example, a first field coil 11*a* is connected to a connection point B close to a joint point A at which the connector bar 38 and a motor lead plate 36 are joined by welding to each other, and a second field coil 11*b* is connected to a connection point C close to one end of the connector bar 38.

In this case, when the connector bar 38 is made of steel so that it has the fusing function, since steel has electrical resistance about six times higher than copper, the output power of the DC motor is lowered due to resistance loss of the connector bar 38. In addition, since the resistance between the joint portion A and the connection point C is larger than the resistance between the joint point A and the connection point B, a current flowing into the second field coil 11*b* is smaller than a current flowing into the first field coil 11*a*. This causes imbalance between the strength of the magnetic field generated by the first field coil 11*a* and the strength of the magnetic field generated by the second field coil 11*b*, as a result of which the efficiency of the DC motor is lowered. This causes the output power of the DC motor to be lowered. In addition, the life of the brush may be shortened.

SUMMARY OF THE INVENTION

The present invention provides a starter comprising:

a DC motor; and a torque transmission device transmitting torque generated by the DC motor to an engine to thereby starting the engine;

the DC motor comprising:

first and second field coils;

an armature coil series-connected to one ends of the first and second field coils through a brush device;

a connector bar to which other ends of the first and second field coils are connected;

a motor lead joined to a joint point of the connector bar at one end thereof; and an electromagnetic switch operative to connect the other end of the motor lead to an external battery;

wherein the connector bar is made of steel, the other end of the first field coil is connected to a first connection point in the connector bar, and the other end of the second field coil is connected to a second connection point in the connector bar, a distance between the joint point and the second connection point being longer than a distance between the joint point and the first connection point, a cross sectional area of a portion of the connector bar lying between the first connection point and the second connection point being larger than a cross sectional area of a portion of the connector bar lying between the joint point and the first connection point.

The present invention also provides a starter comprising:

a DC motor; and a torque transmission device transmitting torque generated by the DC motor to an engine to thereby starting the engine;

the DC motor comprising:

first, second, third, and fourth field coils;

an armature coil series-connected to one ends of the first, second, third, and fourth field coils through a brush device;

a connector bar to which other ends of the first, second third, and fourth field coils are connected;

a motor lead joined to a joint point of the connector bar at one end thereof; and an electromagnetic switch operative to connect the other end of the motor lead to an external battery;

wherein the connector bar is made of steel, the other end of the first field coil is connected to a first connection point in the connector bar, the other end of the second field coil is connected to a second connection point in the connector bar, the other end of the third field coil is connected to a third connection point in the connector bar, and the other end of the fourth field coil is connected to a fourth connection point in the connector bar, a distance between the joint point and the second connection point being longer than a distance between the joint point and the first connection point, a distance between the joint point and the third connection point being longer than a distance between the joint point and the fourth connection point, a cross sectional area of a first portion of the connector bar lying between the first connection point and the second connection point is larger than a cross sectional area of a second portion of the connector bar lying between the joint point and the first connection point, a cross sectional area of a third portion of the connector bar lying between the third connection point and the fourth connection point being larger than a cross sectional area of a fourth portion of the connector bar lying between the joint point and the third connection point.

According to the present invention, the strengths of the magnetic fields generated by a plurality of field coils of the DC motor can be well balanced. This makes it possible to suppress the lowering of the motor output power.

The joint point may be located at an intermediate point which is at equal distances from the first and third connection points. In this case, the cross-sectional area of the first portion is set equal to the cross-sectional area of the third portion, and the cross-sectional area of the second portion is set equal to the cross-sectional area of the fourth portion.

The joint point may be located at a position displaced, towards a side of the fourth connection point by a predetermined distance, from an intermediate point which is at equal distances from the first and third connection points. In this case, the cross-sectional area of the third portion is set smaller than the cross-sectional area of the first portion by a value depending on the predetermined distance, the cross-sectional area of the fourth portion is set smaller than the cross-sectional area of the second portion by a value depending on the predetermined distance.

The connector bar may be made of a steel plate having a uniform thickness, and have a dimension in width direction thereof varying depending on the cross sectional areas of the first to fourth portions.

Other advantages and features of the invention will become apparent from the following description including the drawings and claims.

PREFERRED EMBODIMENTS OF THE INVENTION

First Embodiment

Figure 1:
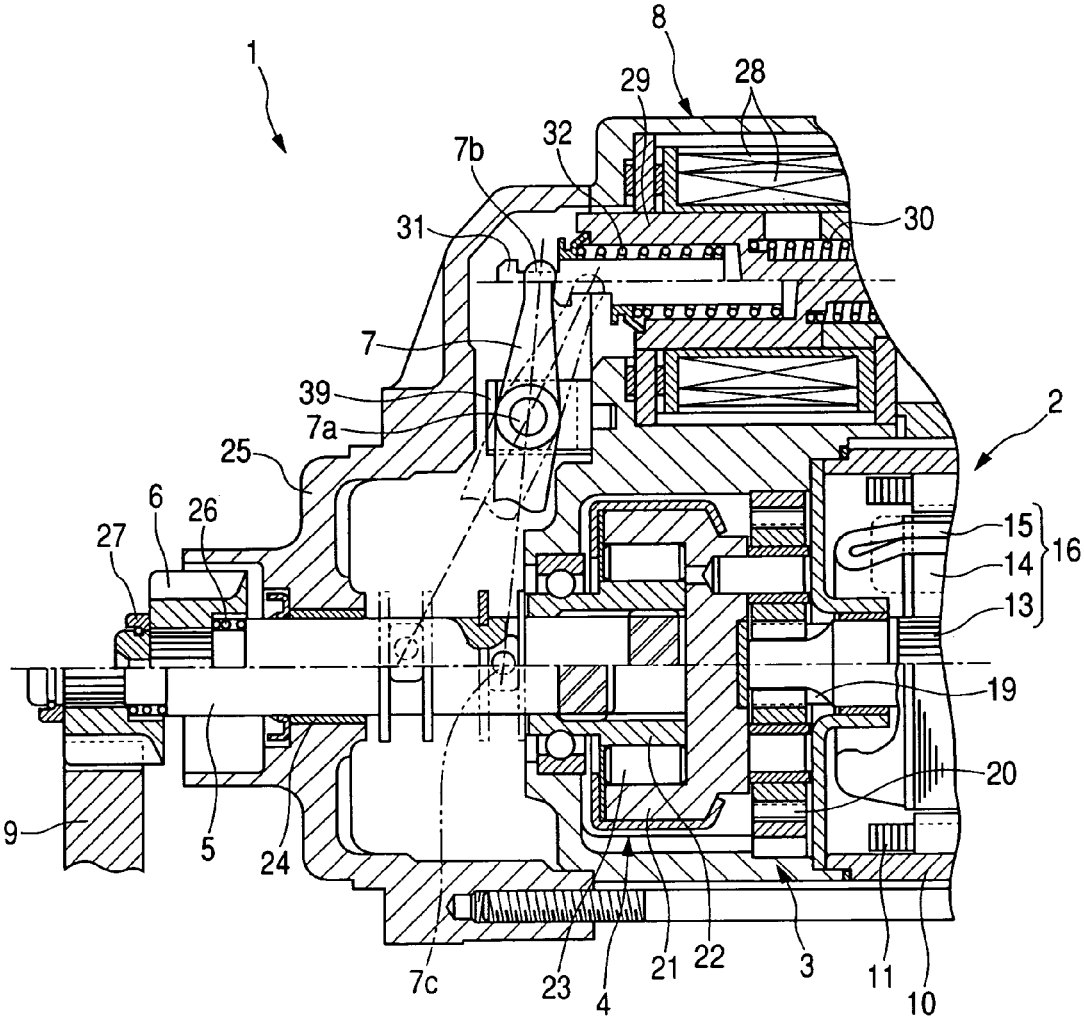
FIG. 1 is a partial cross-sectional view of a starter according to a first embodiment of the invention.

FIG. 1 is a partial cross-sectional view of a starter according to a first embodiment of the invention. As shown in this figure, the starter 1 includes a motor 2 for generating a torque, a reduction device 3, a clutch 4, a pinion shaft 5, a pinion 6 mounted to the pinion shaft 5, and an electromagnetic switch 8. The rotation of the motor 2 is reduced by the reduction device 3, and transmitted to the pinion shaft 5 through the clutch 4. The electromagnetic switch 8 operates to open and close a main contact (to be described later) of a motor circuit (see FIG. 3) to move the pinion shaft 5 in its axial direction through a shift lever 7. An upper part above the center line of the pinion shaft 5 in FIG. 1 shows the starter 1 in resting state, while a lower part shows the starter 1 in operating state in which the pinion shaft 5 has been moved frontward, and the pinion 6 meshes with a ring gear 9 of a vehicle engine. The reduction device 3, clutch 4, pinion shaft 5, and pinion 6 constitute a torque transmission device.

The motor 2 is a DC motor mainly constituted by a field generator 12 (see FIG. 2) including four field coils evenly spaced in a circumferential direction, an armature 16 including an armature shaft 13, an armature core 14 mounted to the armature shaft 13 and an armature coil 15 wound around the armature core 14, and brushes 17 (see FIG. 2) for passing a current to the armature coil 15. When the main contact is closed by the electromagnetic switch 8, the motor 2 is supplied with electric power from a vehicle battery 8 (see FIG. 3) to generate a torque at the armature 16. The reduction device 3 is a planetary gear device including a sun gear 19 formed at one end of the armature shaft 13 around which a plurality of planet gears 20 move while rotating on their axes.

The clutch 4 includes an outer ring 21 configured to rotate by the orbital motions of the planet gears 20 transmitted thereto, an inner ring 22 disposed inside the outer ring 21, and a plurality of rollers disposed between the outer ring 21 and the inner ring 22. The clutch 4 serves as a one-way clutch. To be more specific, at the time of starting the engine, the rollers 23 are locked between the outer ring 21 and the inner ring 22 to allow torque transmission from the outer ring 21 to the inner ring 22, and after the engine is started, the rollers 23 idle between the outer ring 21 and the inner ring 22 to prohibit torque transmission from the inner ring 22 to the outer ring 21.

The pinion shaft 5, which is coaxial with the armature shaft 13, is rotatably and slidably supported by a front housing 25 through a bearing 24 at a front side end portion thereof, and coupled to the inner side of the inner ring 22 by a helical spline at a rear side end portion thereof, such that the pinion 6 is movable within a certain range in the axial direction. The pinion 6 is spline-connected to the front end of the pinion shaft 5 protruding from the bearing 24 so as to be rotatable in one with the pinion shaft 5. The pinion 6 is biased towards the front side (towards the left side in FIG. 1) by a pinion spring 26 located inside the pinion 6, so as to rest against a stopper 27 mounted to the front end of the pinion shaft 5.

The electromagnetic switch 8 includes an excitation coil 28 serving as an electromagnet generating an electromagnetic attraction force when supplied with a current from the battery 18, a plunger 29 which moves by being attracted by the electromagnet, a return spring 30 pushing back the plunger 29 when the attraction force of the electromagnet disappears, a lever hook 31 transmitting the motion of the plunger 29 to the shift lever 7, and a drive spring 32 disposed between the lever hook 31 and the plunger 29. The main contact of the motor circuit is closed when the plunger 29 is moved by the attraction force of the electromagnet. The main contact is opened when the attraction force of the electromagnet disappears, and accordingly the plunger 29 is pushed back by the return spring 30.

Figure 3:
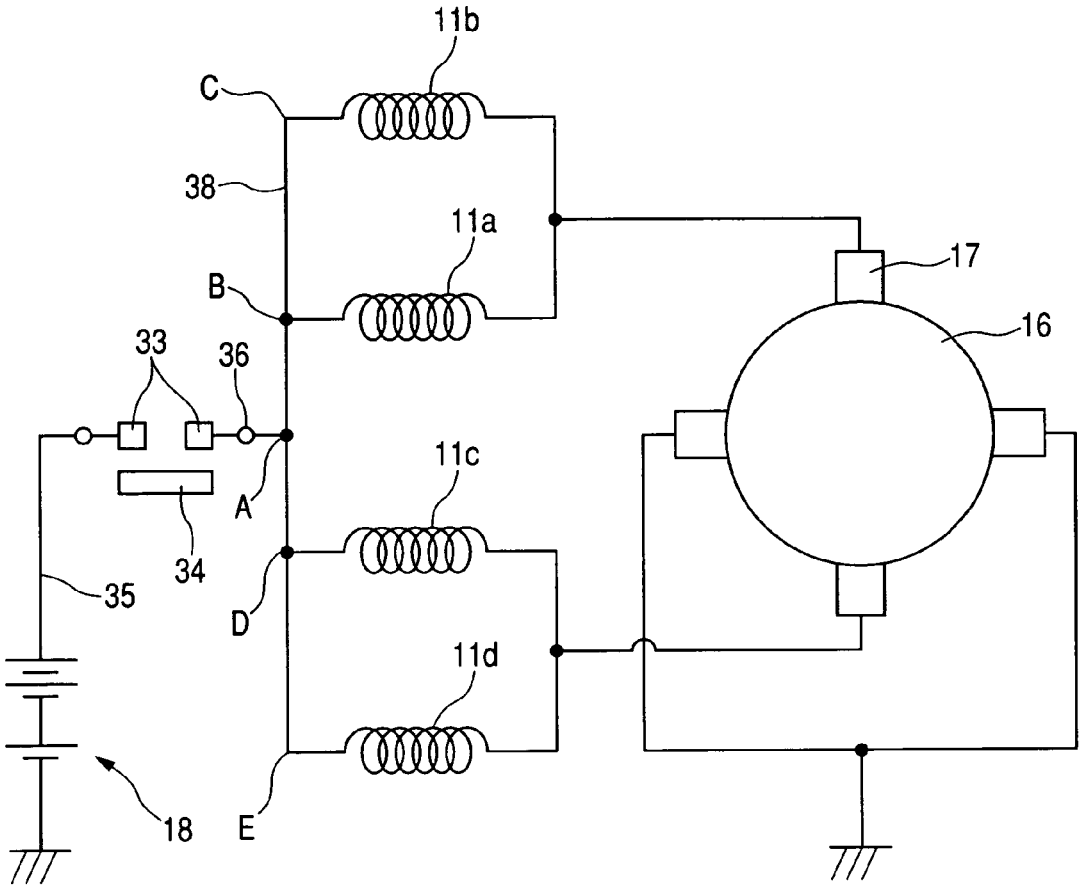
FIG. 3 is circuit diagram of a motor circuit of the DC motor included in the starter shown in FIG. 1.

As shown in FIG. 3, the main contact is constituted by a pair of stationary contacts 33 respectively connected to external terminals, and a movable contact 34 configured to move in conjunction with (or in one with) the plunger 29. To close the main contact, the movable contact 34 makes contact with the stationary contacts 33, and to open the main contact, the stationary contact 34 moves away from the stationary contacts 33. One of the external terminals is a battery terminal connected to the battery 18 through a battery cable 35, and the other is a motor terminal to which a motor lead plate 36 (to be explained later) is connected. One of the stationary contacts 33 is provided integrally with the battery terminal, and the other is provided integrally with the motor terminal.

The motor lead plate 36, which may be made of a copper plate, for example, is inserted into a rubber grommet 37 (see FIG. 2 and FIG. 4) held between an end frame (not shown) and a yoke 10 (see FIG. 1) of the motor 2, and comes out of the motor 2 at one end thereof, the other end of which being located inside the motor 2. The motor lead plate 36 is fixed to the motor terminal by a nut (not shown) at the one end thereof, and welded to the below-explained connector bar 38 at the other end thereof located inside the motor 2.

Figure 2:
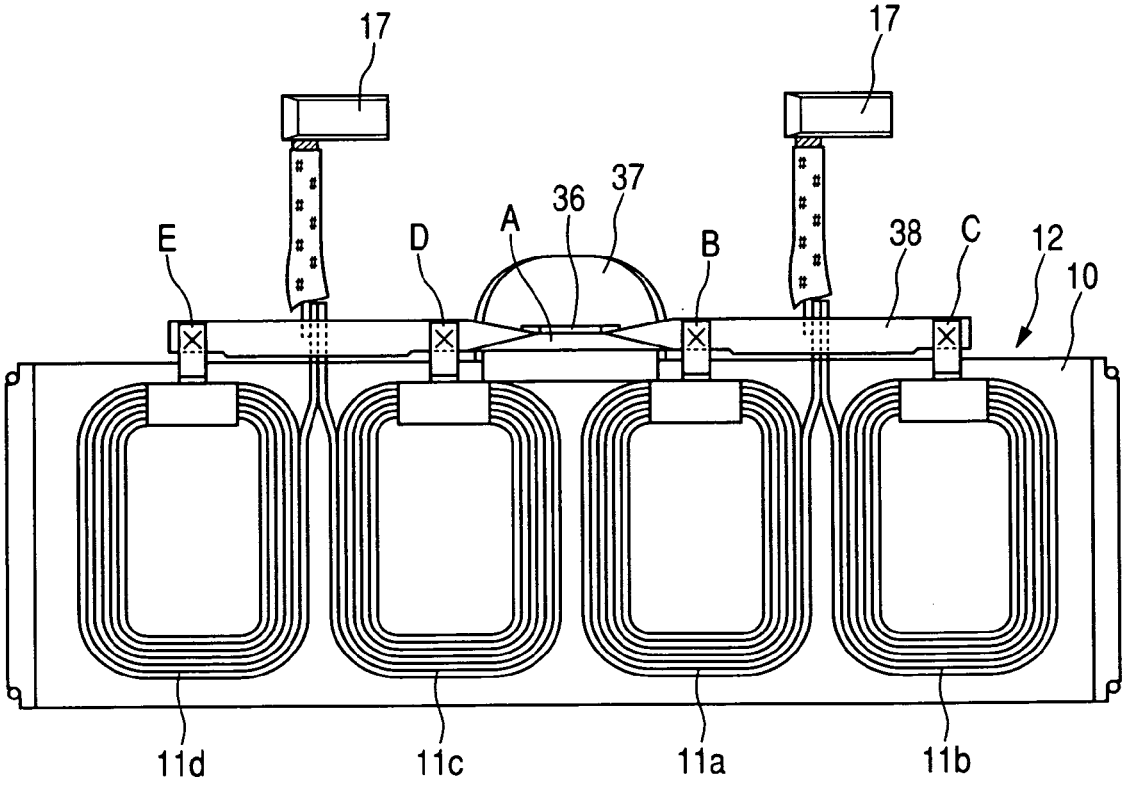
FIG. 2 is a development view of a field generator of a DC motor included in the starter shown in FIG. 1.
Figure 5:
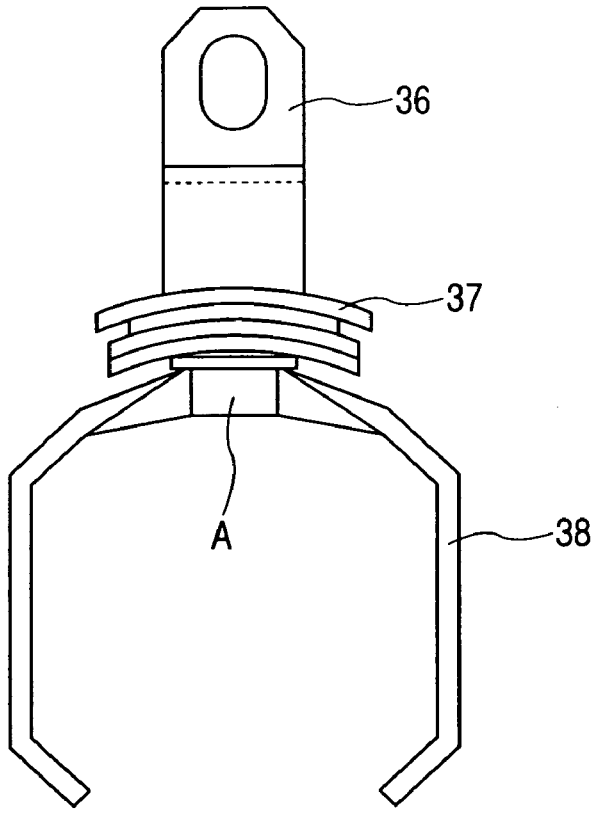
FIG. 5 is a plan view of a connector bar of the DC motor included in the starter shown in FIG. 1.

The connector bar 38, which is for electrically connecting the motor lead plate 36 to the four field coils 11, is made of an elongate steel plate bent in the shape of C, and joined by welding to the motor lead plate 36 at its center portion in the longitudinal direction as shown in FIG. 5. Hereinafter, a welded portion between the motor lead plate 36 and the connector bar 38 is referred to as a joint point A. As shown in FIG. 2, the four field coils 11 (the first to fourth field coils 11*a*-11*d*) are connected to the connector bar 38 such that the first field coil 11*a* and the second field coil 11*b* are connected to the connector bar 38 at the side lying between the joint point A and one end (the right side end in FIG. 2) of the connector bar 38, and the third field coil 11*c* and the fourth field coil 11*d* are connected to the connector bar 38 at a side lying between the joint point A and the other end (the left side end in FIG. 2) of the connector bar 38.

Figure 4:
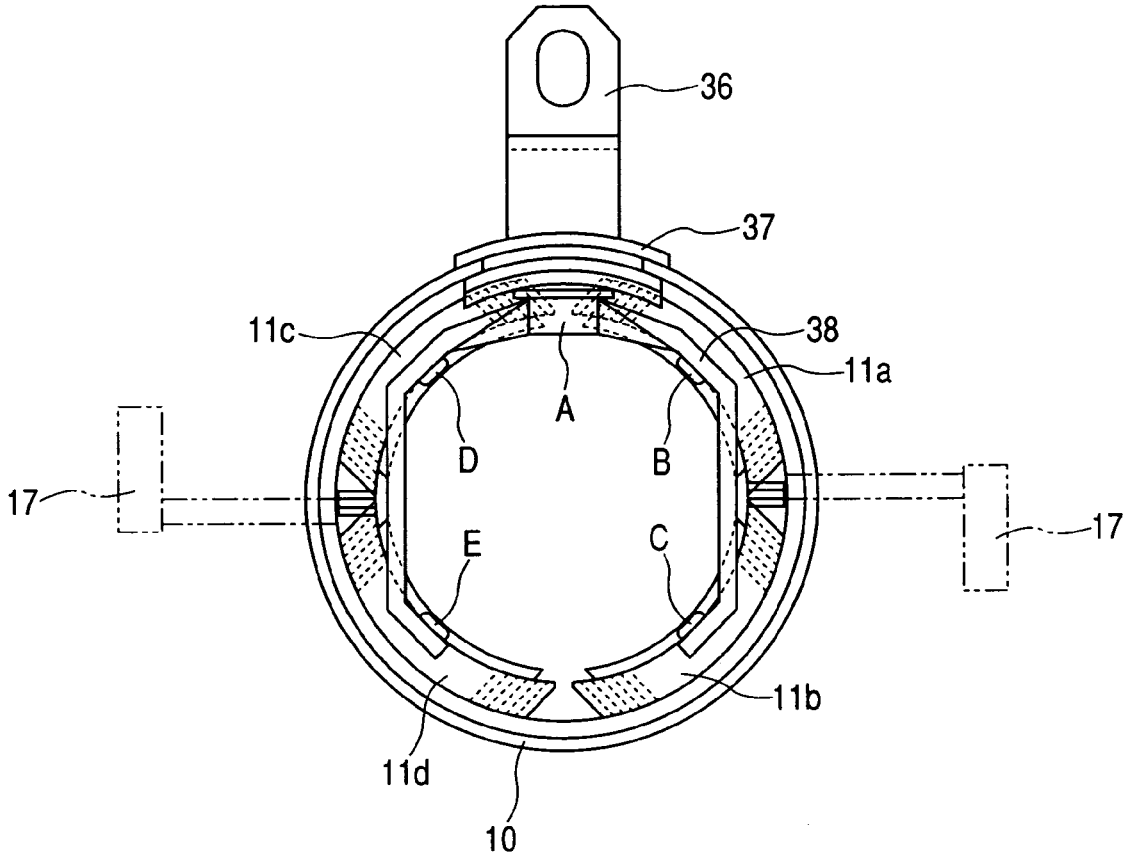
FIG. 4 is an axial plan view of a field generator of the DC motor included in the starter shown in FIG. 1.

More specifically, as shown in FIGS. 2 and 4, the distance between the joint point A and the connection point C at which the second field coil 11*b* is connected to the connector bar 38 is longer than the distance between the joint point A and the connection point B at which the first field coil 11*a* is connected to the connector bar 38. Likewise, the distance between the joint point A and the connection point E at which the fourth field coil 11*d* is connected to the connector bar 38 is longer than the distance between the joint point A and the connection point D at which the third field coil 11*c* is connected to the connector bar 38. The first and second field coils 11*a* and 11*c* are disposed symmetrically with respect to the junction point A, and the second and fourth field coils 11*b* and 11*d* are disposed symmetrically with respect to the joint point A.

Figure 6:
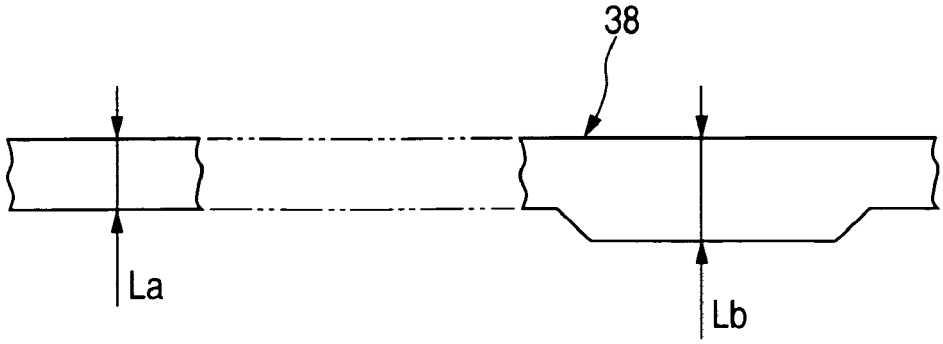
FIG. 6 is a partially enlarged side view of the connector bar of the DC motor included in the starter shown in FIG. 1.

The connector bar 38 has such a shape that the cross-sectional area of the portion from the connection point B to the connection point C is larger than that of the portion from the joint point A to the connection point B, and the cross-sectional area of the portion from the connection point D to the connection point E is larger than that of the portion from the joint point A to the connection point D. And the cross-sectional area of the portion from the joint point A to the connection point B is the same as that of the portion from the joint point A to the connection point D, and the cross-sectional area of the portion from the connection point B to the connection point C is the same as that of the portion from the connection point D to the connection point E. The connector bar 38 is shaped symmetrically in the length direction with respect to the joint point A. The connector bar 38 has a uniform thickness throughout its length, and accordingly the cross-sectional area of the connector 38 is adjusted by changing the dimension in its width direction. More specifically, as shown in FIG. 6, the dimension La in the width direction of the portion between the joint point A and the connection point B and the portion between the joint point A and the connection portion D is larger than the dimension Lb in the width direction of the portion between the connection point B and the connection point C and the portion between the connection point D and the connection portion E.

The shift lever 7, which is swingably supported by a lever holder 39 at a pivot portion 7*a* thereof, is coupled to the lever hook 31 held by the plunger 29 at a lever end portion 7*b* thereof lying between the pivot portion 7*a* and one end thereof, and engaged to the pinion shaft 5 at another lever end portion 7*c* thereof. When the plunger 29 moves to the right side in FIG. 1 while pulling the lever end portion 7*b* by being attracted by the electromagnet, the lever end portion 7*c* swings around the pivot portion 7*a* to thereby push out the pinion shaft 5 in a direction opposite to the motor 2 (in the left direction in FIG. 1). When the attraction force of the electromagnet disappears, and accordingly the plunger 29 is pushed back, the shift lever 7 swings in the opposite direction, as a result of which the pinion shaft 5 is pushed back towards the motor 2.

Next, the operation of the starter 1 is explained.

When a starter switch (not shown) is operated to an on position to pass a current to the electromagnet constituted by the excitation coil 28 of the electromagnetic switch 8, the plunger 29 moves rightward in FIG. 1 by the attraction force of the electromagnet. This motion of the plunger 29 is transmitted to the pinion shaft 5 through the shift lever 7, and accordingly the pinion shaft 5 is pushed in the direction opposite to the motor 2, causing the pinion 6 mounted to the pinion shaft 5 to abut against the ring gear 9 with the pinion spring 26 being compressed.

After that, when the plunger 29 further moves while accumulating a repulsive force in the drive spring 32, the main contact is closed to supply electric power from the battery 18 to the motor 2 so that a torque is generated at the armature 16. The rotation of the armature 16 is reduced by the reduction device 3, and transmitted to the pinion shaft 5 through the clutch 4. As a result, since the pinion shaft 5 is caused to rotate, the pinion 6 meshes with the ring gear 9 by the action of the repulsive force accumulated in the drive spring 32 when the pinion 6 rotates to a position at which the pinion 6 and the ring gear 9 can be in engagement with each other, to thereby crank the engine.

When the starter switch is operated to an off position after the engine enters a complete explosion state, the supply of the current to the excitation coil 28 is stopped, as a result of which the attraction force of the electromagnet disappears, and the plunger 29 is pushed back by the action of the return spring 30. As a consequence, the main contact of the motor circuit is opened to stop the supply of electric power to the motor 2, causing the armature 16 to stop its rotation. And, when the plunger 29 is pushed back, the shift lever 7 swings in a direction opposite to the direction in which the shift lever 7 swings at the time of starting the engine, as a result of which the pinion shaft 5 is pushed back until the rear end thereof rests against an end surface of the outer ring 21.

The above described starter 1 of the first embodiment offers the following advantages.

The connector bar 38 has the fuse function, because it is made of steel having much higher (about six times higher) electrical resistance than copper. Accordingly, if an excessive thermal load is applied to the motor circuit, the connector bar 38 melts by Joule heat to protect the motor circuit.

The joint point A is at equal distances from the connection point B to which the first field coil 11*a* is connected, and the connection point D to which the third field coil 11*c* is connected. The cross-sectional area of the portion from the connection point B to the connection point C is larger than that of the portion from the joint point A to the connection point B. Likewise, the cross-sectional area of the portion from the connection point D to the connection point E is larger than that of the portion from the joint point A to the connection point D. On the other hand, the cross-sectional area of the portion from the joint point A to the connection point B is the same as that of the portion from the joint point A to the connection point D. Likewise, the cross-sectional area of the portion from the connection point B to the connection point C is the same as that of the portion from the connection point D to the connection point E.

Accordingly, a voltage drop due to electrical resistance across the portion from the connection point B to the connection point C can be made small compared to that of the portion from the joint point A to the connection point B. This makes it possible to largely remove the difference between the voltage applied across the first field coil 11*a* and the voltage applied across the second field coil 11*b*, and accordingly to reduce the imbalance between the strength of the magnetic field generated by the first field coil 11*a* and the strength of the magnetic field generated by the second field coil 11*b*. For the same reason, the imbalance between the strength of the magnetic field generated by the third field coil 11*c* and the strength of the magnetic field generated by the fourth field coil 11*d* can be largely removed.

Hence, the strengths of the magnetic fields generated by the first to fourth field coils 11*a* to 11*d* can be well balanced. This makes it possible to suppress the lowering of the motor output power. The connector bar 38 can be made of a steel plate having a uniform thickness which is low in price, because the cross-sectional area thereof is adjusted by changing the dimension in the width direction thereof. Since the connector bar 38 can be made without joining a plurality of plates having different cross sectional areas, the connector bar 38 can be provided at low cost.

Second Embodiment

The second embodiment is characterized in that the joint point A between the connector bar 38 and the motor lead plate 36 is displaced towards either end of the connector bar 38 from the center point which is at equal distances from the connection point B and the connection point D.

In the first embodiment, the joint point A is located at the center in the longitudinal direction of the connector bar 38. However in some cases, the connection point A can not be located at the center of the connector bar 38, or it is rather preferable to displace the joint point A from the center of the connector bar 38. In such cases, since the distances between the joint point A and the connection point B and between the joint point A and the connection point C are different from those between the joint point A and the connection point D and between the joint point A and the connection point E, it is preferable to make a difference between the cross-sectional area of the portion from the joint point A to the connection point B and that of the portion from the joint point A to the connection point D, and to make a difference between the cross-sectional area of the portion from the connection point B to the connection point C and that of the portion from the connection point D to the connection point E.

For example, when the joint point A is located in a position displaced towards the side of the connection point D from the center of the connector bar 38, the cross-sectional area of the portion from the joint point A to the connection point D is set smaller than that of the portion from the joint point A to the connection point B by a value depending on a displacement of the connection point A, and the cross-sectional area of the portion from the connection point D to the connection point E is set smaller than that of the portion from the connection point B to the connection point C by a value depending on the displacement of the joint point A. This makes it possible to well balance the strengths of the magnetic fields generated by the first to fourth field coils 11*a* to 11*d*, to thereby suppress the lowering of the motor output power.

Although the above described embodiments are directed to a starter including a DC motor having four field coils, it should be noted that the present invention is applicable to a starter including a DC motor having two field coils, or a DC motor having six field coils.

The above explained preferred embodiments are exemplary of the invention of the present application which is described solely by the claims appended below. It should be understood that modifications of the preferred embodiments may be made as would occur to one of skill in the art.

What is claimed is:

1. A starter comprising:

a DC motor; and a torque transmission device transmitting torque generated by said DC motor to an engine to thereby starting said engine;

said DC motor comprising:

first and second field coils;

an armature coil series-connected to one ends of said first and second field coils through a brush device;

a connector bar to which other ends of said first and second field coils are connected;

a motor lead joined to a joint point of said connector bar at one end thereof; and an electromagnetic switch operative to connect the other end of said motor lead to an external battery;

wherein said connector bar is made of steel, said other end of said first field coil is connected to a first connection point in said connector bar, and said other end of said second field coil is connected to a second connection point in said connector bar, a distance between said joint point and said second connection point being longer than a distance between said joint point and said first connection point, a cross sectional area of a portion of said connector bar lying between said first connection point and said second connection point being larger than a cross sectional area of a portion of said connector bar lying between said joint point and said first connection point.

2. A starter comprising:

a DC motor; and a torque transmission device transmitting torque generated by said DC motor to an engine to thereby starting said engine;

said DC motor comprising:

first, second, third, and fourth field coils;

an armature coil series-connected to one ends of said first, second, third, and fourth field coils through a brush device;

a connector bar to which other ends of said first, second third, and fourth field coils are connected;

a motor lead joined to a joint point of said connector bar at one end thereof; and an electromagnetic switch operative to connect the other end of said motor lead to an external battery;

wherein said connector bar is made of steel, said other end of said first field coil is connected to a first connection point in said connector bar, said other end of said second field coil is connected to a second connection point in said connector bar, said other end of said third field coil is connected to a third connection point in said connector bar, and said other end of said fourth field coil is connected to a fourth connection point in said connector bar, a distance between said joint point and said second connection point being longer than a distance between said joint point and said first connection point, a distance between said joint point and said third connection point being longer than a distance between said joint point and said fourth connection point, a cross sectional area of a first portion of said connector bar lying between said first connection point and said second connection point is larger than a cross sectional area of a second portion of said connector bar lying between said joint point and said first connection point, a cross sectional area of a third portion of said connector bar lying between said third connection point and said fourth connection point being larger than a cross sectional area of a fourth portion of said connector bar lying between said joint point and said third connection point.

3. The starter according to claim 2, wherein said joint point is located at an intermediate point which is at equal distances from said first and third connection points, said cross-sectional area of said first portion being equal to said cross-sectional area of said third portion, said cross-sectional area of said second portion being equal to said cross-sectional area of said fourth portion.

4. The starter according to claim 2, wherein said joint point is located at a position displaced, towards a side of said fourth connection point by a predetermined distance, from an intermediate point which is at equal distances from said first and third connection points, said cross-sectional area of said third portion being smaller than said cross-sectional area of said first portion by a value depending on said predetermined distance, said cross-sectional area of said fourth portion being smaller than said cross-sectional area of said second portion by a value depending on said predetermined distance.

5. The starter according to claim 2, wherein said connector bar is made of a steel plate having a uniform thickness, and has a dimension in width direction thereof varying depending on said cross sectional areas of said first to fourth portions.

* * * * *